United States Patent [19]

Braverman et al.

[11] Patent Number: 5,062,231

[45] Date of Patent: Nov. 5, 1991

[54] DUEL PROFILE PEN GUN

[75] Inventors: Robert J. Braverman, Marblehead; Isaak M. Shklyarov, Boston, both of Mass.

[73] Assignee: R. J. Braverman Corp., Winthrop, Mass.

[21] Appl. No.: 653,496

[22] Filed: Feb. 8, 1991

[51] Int. Cl.[5] ..... F41C 9/02

[52] U.S. Cl. ..... 42/1.09

[58] Field of Search ..... 42/1.08, 1.09, 1.15, 42/1.16

[56] References Cited

U.S. PATENT DOCUMENTS

| | | | |
|---|---|---|---|
| 1,608,359 | 11/1926 | Biason | 42/1.09 |
| 1,664,049 | 3/1928 | Sedgby | 42/1.09 |
| 2,844,902 | 7/1958 | Gaylord, Jr. et al. | 42/1.09 |
| 3,979,850 | 9/1976 | Schiessl et al. | 42/1.08 |
| 4,490,935 | 1/1985 | Plachy | 42/1.09 |

*Primary Examiner*—Charles T. Jordan

[57] ABSTRACT

A highly concealable, hand held, single shot weapon of novel design having the appearance and esthetics of a pen like instrument when in a neutral, non-firing mode, which can be actuated by simultaneously pulling the barrel forward and the rear housing rearward in one quick motion, and hinging the rear housing of the device down 90° to the main body and barrel. In this position the weapon is in the ready to fire position and can be held in the palm of the hand safely, indefinately. The weapon can either be fired or returned to a neutral position. To fire, press the trigger inward which releases the compressed firing pin assembly to slide forward into the cartridge. To put the weapon into a safe position, hinge the rear housing of the device upward while pressing the safety button inward and the device will resume a straight pen like appearance.

2 Claims, 1 Drawing Sheet

DUEL PROFILE PEN GUN

BACKGROUND OF THE INVENTION

This invention relates to a single shot pistol in which the gun barrel, stock, and other parts thereof are formed and axially aligned to simulate the appearance of a conventional pen like instrument of the type with a clip which can easily be carried and concealed in the pockets of garments. Here to fore, guns of this type, generally referred to as "pen guns", have been of varied style and function, and in a traditional straight axial configuration. In U.S. Pat. No. 1,608,359 issued to Sergio M Biason in 1926, a pen gun device is shown that combines a writing instrument with a mechanism for firing a single bullet. This device has a protruding external firing mechanism which necessitates the users thumb be kept firmly attached to the cocked firing mechanism to facilitate the firing of this weapon.

In U.S. Pat. No. 1,664,049 issued to Reginald F Sedgley in 1928, the inventor creates a pen gun that is a firearm designed to appear as a writing instrument for concealment purposes. This firearm is an improvement in that the firing and handling of this weapon is comfortable and less prone to accidental firing.

In U.S. Pat. No. 2,844,902 issued to Gaylord, Jr. et al in 1954, we have a pen gun with the appearance of a pen for concealment purposes. It has been designed with a protruding firing mechanism which is meant to be cocked, held, then released by the users thumb.

In U.S. Pat. No. 4,490,935 issued to Joseph Plachy in 1985, we have a combination writing instrument and firearm. This invention is a design improvement in that it has no external protrusions which greatly improves its pen like appearance.

The present invention overcomes the problems of the prior pen gun inventions by providing a smooth modern appearance, a simple but effective safety mechanism, a more effective trigger cocking mechanism, and can be comfortably held in the firing position safely with one hand for an indefinate period of time, and takes the profile of a traditional hand gun with the guns grip at an angle to and below the axis of the bore for a more accurate aim.

SUMMARY OF THE INVENTION

This invention relates to a concealed single shot weapon commonly referred to as a "pen gun", which has the esthetic appearance of a pen like instrument, which can be concealed in the pockets of a persons clothing.

This invention is comprised of four body members made of a rigid material that is elongated and cylindrical and has a hollow center passage. The front member, a chamber area for receiving a single cartridge, and commonly referred to as the barrel is threaded on one end for engagement with a central member. This central member, threaded to engage the barrel, is the main body of the firearm which houses the firing pin carrier assembly. The third body member is the rear housing and is used to cock the firing pin assembly into a ready to fire position. The rear housing, which is the handle of the weapon, is made to slip over the rear section of the main body and the fourth body member, the internal rear body. This present invention provides a pistol device of novel construction and arrangement embodying a firing pin carrier assembly mounted for reciprocative movement within a central body member. The firing pin assembly has been adapted to be manually moved rearward to a retracted and cocked position by grasping the barrel in one hand pulling forward while grasping the rear housing with the other hand pulling rearward thus exposing an internal hinge assembly connecting the rear section of the main body and the internal forth body member. The rear housing is then hinged downward at approximately 90° to the barrel and main body section which allows the trigger to pop out from within an internal slot within the rear housing. Further, this hinging down has caused the internal control pin assembly within the forth body section to rotate a cam which is in contact with a slot in the firing pin carrier to force that carrier rearward, compressing the firing pin spring into a ready to fire position. To fire, press the trigger inward which will force the control pin down and out of the cam, which releases the compressed firing pin carrier assembly to move forward into the breech block. The breech block is provided with an aperture through which the firing pin will extend through and contact the cartridge with sufficient kinetic energy causing the weapon to fire.

OBJECTS AND ADVANTAGES

It is an object of this invention;

1. To provide a safe and useful firearm which can be carried on the person and be used as an effective emergency defense weapon.
2. To improve the engineering design of previous pen gun patents by removing external protruding firing mechanisms that must be held in the firing position using two hands.
3. To provide a smooth, clean, modern design of a pen like instrument which is highly concealable.
4. To offer an improved pen gun design which allows the weapon to be carried in a cocked and ready to fire position and can be safely discharged using one hand.
5. To offer an improved pen gun design that offers a simple, and straight forward mechanical design that embodies all the benefits of a safe, effective, reliable firearm.
6. To provide a pen gun device which is relatively simple, and inexpensive to manufacture.
7. To create a pen gun that resembles the traditional straight axial design of all past pen gun art when in a neutral, non-firing mode, but must be fired like a standard handgun with the guns grip at an angle to and below the axis of the bore.

In accordance with these and other objects which will become apparent hereinafter, this pen gun design will now be described with particular reference to the accompanying drawings.

DRAWING FIGURES

DRAWING REFERENCE NUMBERS

1: Barrel
2: Barrel Bore
3: Cartridge
4: Threaded Connection: barrel to main body
5: Breech Block
6: Breech Block Aperture
7: Safety Button Aperture
8: Safety Button Housing
9: Safety Button
10: Safety Button Compression Spring
11: Main Body
11A: Main Body Hinge Joint
12: Firing Pin
13: Firing Pin Carrier
14: Firing Pin Compression Spring
15: Cam Slot in Firing Pin Carrier
16: Cam
17: Axis Pin for Cam and Hinge Joints
18: External Rear Housing
18A: Retaining Wall
19: Control Pin
19A: Control Pin Carrier
20: Internal Rear Housing
20A: Internal Rear Housing Hinge Joint
21: Trigger Cavity in Control Pin Carrier
22: Trigger Slot in Internal Rear Housing
23: Trigger Slot in External Rear Housing
24: Trigger
25: Trigger Axis Pin
26: Control Pin Compression Spring
27: External Rear Housing Compression Spring
28: Rear Cap
29: Set Screw
30: Pen Clip

PREFERRED EMBODIMENT

Figure 1:
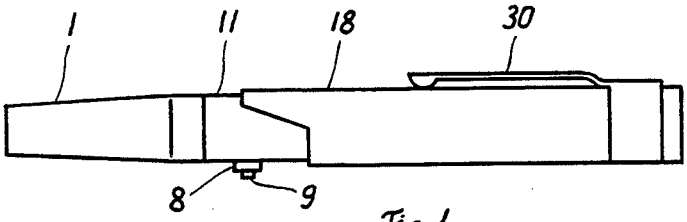
FIG. 1 shows a side elevational view of the present invention.

Referring to the drawings, the present invention, the single shot pistol is shown on FIG. 1, comprising a barrel 1 mounted in axial alignment on the forward end of the main body 11 and the external rear housing 18 to simulate the appearance of a pen like instrument. The safety button 9 is in a neutral position and the trigger 24 is hidden from view by rear housing 18 and pen clip 30 has been added which further adds to its pen like appearance.

Figure 2:
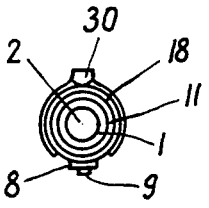
FIG. 2 shows an end elevational view showing the barrel end of the present invention.

FIG. 2 shows the front end view of the invention straight along the axis showing the barrel bore 2, barrel 1, main body 11, safety button housing 8, safety button 9, and pen clip 30.

Referring now to FIGS. 3, 4, 5, and 6, the internal mechanisms of the invention are shown. The forward end of the main body 11 is threaded 4 to which barrel 1 is mounted in axial alignment. The barrel 1 is formed with a bore 2 and an area to snugly receive a cartridge 3. The main body 11 is provided with a breech block 5 formed with an aperture 6 to slidably receive the firing pin 12 mounted on the forward end of firing pin carrier 13. The internal section of the main body 11 through which a central passage has been formed from breech block 5 rearward into the external rear housing 18 and internal rear housing 20 and terminating at rear cap 28. Further, the main body 11 is provided with a safety button assembly which is comprised of the safety button housing 8, safety button 9, compression spring 10, and aperture 7, as shown on FIG. 4; which shows the mechanism in a neutral position. This safety mechanism is designed to block the forward motion of the firing pin carrier 13 when the weapon is in a straight or neutral position as shown on FIG. 6. To operate the safety mechanism the firing pin carrier 13 must be drawn back into a ready to fie position as shown on FIG. 3. Then depress the safety button 9 inward compressing spring 10 and allowing the rearward end of the safety button 9 to extend through aperture 7 and into the interior of main body 11. The firing pin carrier 13 is then allowed to slide forward into the exposed safety button end 9; thus neutralizing each other. The safety button 9 holds the firing pin carrier 13 which is under pressure from spring 14 from moving past, while the pressurized firing pin carrier 13 in-turn holds the safety button 9 which is under pressure from spring 10 from popping out.

Figure 5:
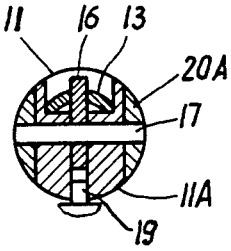
FIG. 5 shows a top elevational view in cross section of the hinge and cam section.

The firing pin assembly is comprised of the firing pin 12, firing pin carrier 13, compression spring 14, cam slot 15, cam 16, and axis pin 17. The cam 16 is controlled by control pin 19 which fits into the bottom angular edge of cam 16 which rotates on axis pin 17. The rotation of cam 16 in-turn retracts the firing pin carrier 13 rearward through its connection with cam slot 15 on the rear section of the firing pin carrier 13. The cam 16 is set between the main body hinge 11A and the internal rear housing hinge 20A and is held in place by axis pin 17 which also allows for rotation. FIG. 5 shows the relationship of the hinge area and the interaction of all its parts.

Figure 3:
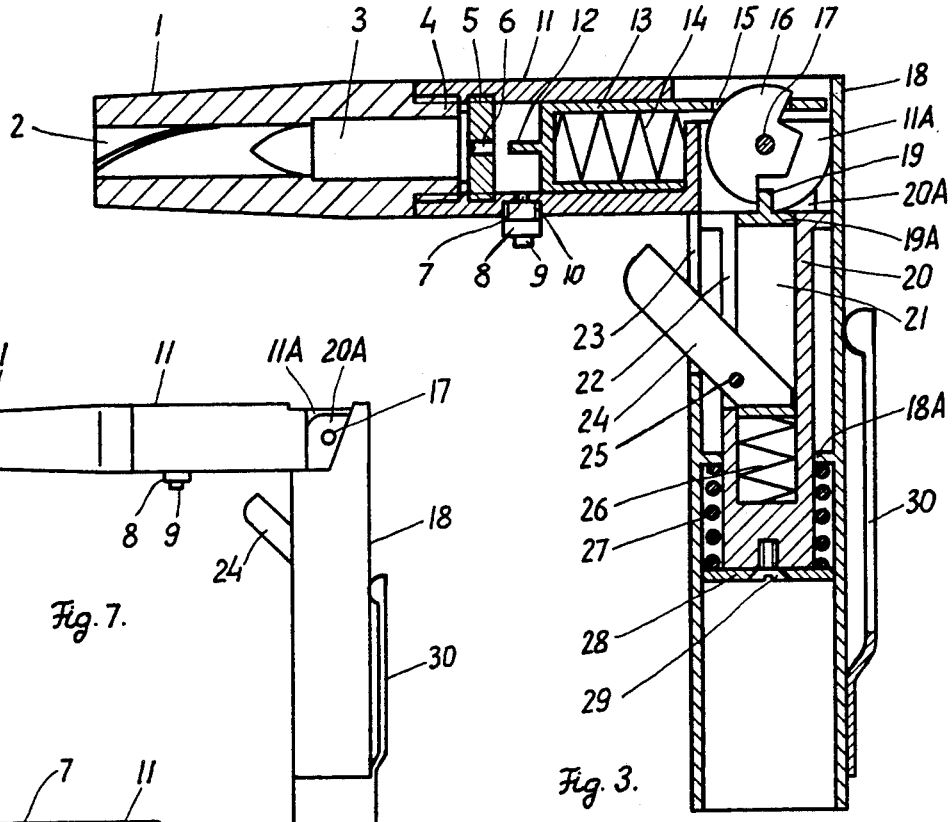
FIG. 3 shows a side elevational view in cross section showing the present invention in the hinged, ready to fire position, with the firing pin assembly drawn back and the trigger exposed.
Figure 7:
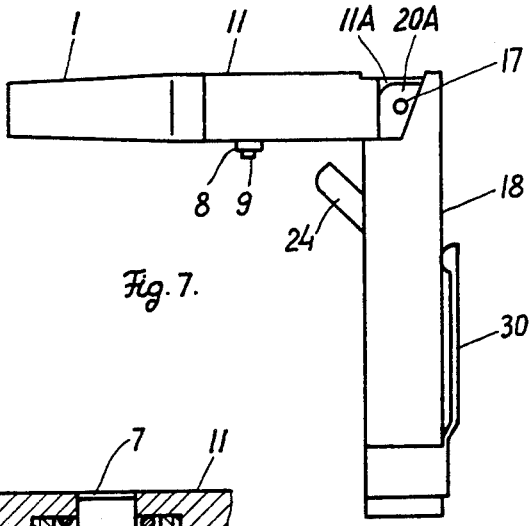
FIG. 7 shows a side elevational view of the present invention in a hinged and ready to fire position with the trigger exposed.
Figure 4:
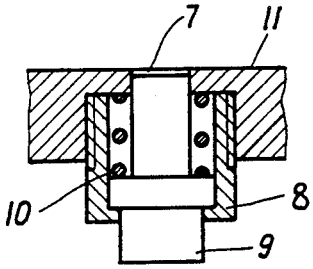
FIG. 4 shows a side elevational view in cross section of the safety button assembly.
Figure 6:
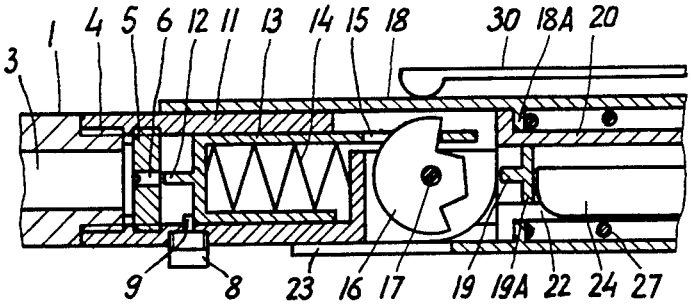
FIG. 6 shows a side elevational view in cross section of the present invention in a straight and neutral position with the safety button holding the firing pin assembly from moving forward.

The rear housing 18 is a cylindrical rigid member which has been hollowed to encase the interior rear housing 20, compression spring 27, and rear cap 28. The external rear housing 18 has been designed to move slidably forward and rearward. The front section of the external rear housing 18 acts as a cover to encase the hinge section, trigger assembly, and to hold the device in a rigid, straight pen like position when in a neutral mode. The internal rear housing 20 encased within the external rear housing 18 is a cylindrical rigid member which has been hollowed to encase the control pin carrier 19A & compression spring 26. The control pin carrier 19A is a cylindrical rigid member with a hollow cavity 21 which encases trigger 24, and has control pin 19 mounted on its forward end. To put the invention in a ready to fire position the rear housing 18 is pulled slidably rearward compressing spring 27 against retaining wall 18A and rear cap 28, thus exposing hinge joints 11A and 20A, trigger slots 22 and 23, and trigger 24. The rear housing is then hinged down approximately 90° to main body 11 and barrel 1. The control pin 19 atop control pin carrier 19A rotates cam 16 clockwise on axis pin 17 which in-turn through contact with cam 16 and firing pin slot 15 retracts firing pin carrier 13, compressing spring 14, and allows safety button 9 to pop out. The invention as shown in FIGS. 3 and 7 is in the ready to fire position. To fire, trigger 24 is pressed inward which is set on axis pin 25 which allows the rear shoulder of trigger 24 to push down on control pin carrier 19A, compressing spring 26, and retracting control pin 19 from cam 16. With cam 16 free to rotate and no longer restricting movement of the firing pin carrier 13, the compressed spring 14 forces the firing pin carrier forward with sufficient kinetic energy, forcing firing pin 12 through breech block aperture 6, hitting cartridge 3, causing it to fire. To return the invention to a neutral mode, the rear housing 18 is hinged upwards, thus allowing compressed spring 27 to force rear housing 18 forward, encasing trigger 24, trigger slots 22 and 23, and the hinge joint area. Set screw 29 is used to connect the rear cap 28 and internal rear housing 20.

While the above description contains many specificities, the reader should not construe these as limitations on the scope of the invention, but merely as exemplifications of preferred embodiments thereof. Those skilled in the art will envision many other possible variations are within its scope. For example, skilled artisans will readily be able to change dimensions and shapes of various embodiments. They will be able to make this firearm of many alternative materials such as modern plastics, and can make variations on the firing pin mechanism, safety button design, cam and hinge assembly, and new and alternative ways of connecting body members.

This invention has been shown and described herein in what is considered to be the most practical and preferred embodiment. Accordingly, the scope of the invention should be determined by the embodiment illustrated, the claims and their legal equivalents.

Having thus described the invention, I claim as new and desire to secure by Letters Patent:

1. A single shot pistol which simulates the appearance of a modern pen like instrument, comprised of a barrel adapted to receive a cartridge and threadably connected to a main body having coaxial front and rear bores spaced apart by a breech block with an aperture through which a firing pin assembly which is mounted for reciprocative movement in said rear bore can project a firing pin through said aperture and engage and fire said cartridge after the firing pin assembly has been retracted and locked into a ready to fire position by simultaneously pulling the barrel forward and the rear housing rearward which exposes a hinge joint that will allow a rear handle to be bent downward, exposing a hidden trigger and causing a firing pin carrier to be drawn rearward until it is released by pressing the trigger inward causing a control pin to release a cam which in-turn releases the firing pin carrier under pressure from a compressed spring to force the firing pin carrier forward with sufficient kinetic energy to fire said cartridge.

2. A single shot pistol which simulates the appearance of a modern pen like instrument when in a neutral, non-firing mode, and must be fired with the gun rear handle at an angle to and below the axis of the bore, comprised of a barrel adapted to receive a cartridge and connected to a main body having coaxial front and rear bores spaced apart by a breech block with an aperture through which a firing pin assembly which is mounted for reciprocative movement in said rear bore can project a firing pin through said aperture and engage and fire said cartridge after the firing pin assembly has been retracted and locked into a ready to fire position by simultaneously pulling the barrel forward and the rear housing rearward which exposes a hinge joint that can be bent downward, exposing a hidden trigger, and causing a firing pin carrier to be drawn rearward, which releases a safety button which had restricted the firing pin carrier's forward movement, which now can be released by pressing the trigger inward causing a control pin to release a cam which in-turn releases the firing pin carrier under pressure from a compressed spring to force the firing pin carrier forward with sufficient force to fire said cartridge.

* * * * *